United States Patent [19]

Collins

[11] 4,360,154

[45] Nov. 23, 1982

[54] RAIL JOINT BAR BOLT NUT LOCKING ASSEMBLY

[76] Inventor: Jesse P. Collins, 310 Harpers Ferry Rd., Louisville, Ky. 40214

[21] Appl. No.: 179,127

[22] Filed: Aug. 18, 1980

[51] Int. Cl.[3] ..... E01B 11/38; F16B 39/02; F16B 39/10

[52] U.S. Cl. ..... 238/262; 238/342

[58] Field of Search ..... 238/262, 342; 295/36 R

[56] References Cited

U.S. PATENT DOCUMENTS

| | | | |
|---|---|---|---|
| 439,722 | 11/1890 | Cox | 238/262 |
| 742,057 | 10/1903 | Owen et al. | 238/262 |
| 966,949 | 8/1910 | Posson | 238/262 |
| 1,531,216 | 3/1925 | Phelps | 238/262 X |
| 3,523,709 | 8/1970 | Heggy et al. | 295/36 R |

*Primary Examiner*—Robert B. Reeves
*Assistant Examiner*—Howard Beltran
*Attorney, Agent, or Firm*—Francis H. Boos

[57] ABSTRACT

Track rail joint assemblies with nut and bolt fasteners are disclosed in which a nut restraining plate is interposed on the bolt between the nut and the joint bar. The plate is provided with one or more bendable tabs adjacent the bolt of hole which are bent away from the joint bar against the nut after the nut has been tightened down to effectively lock the nut into position and prevent loosening rotation tended to be caused by vibrational forces of railroad equipment passing over the joint. The plate is formed with the tabs slightly bent to permit bending tools to be slipped over the tabs when the plate is in position under the tightened down nut.

6 Claims, 10 Drawing Figures

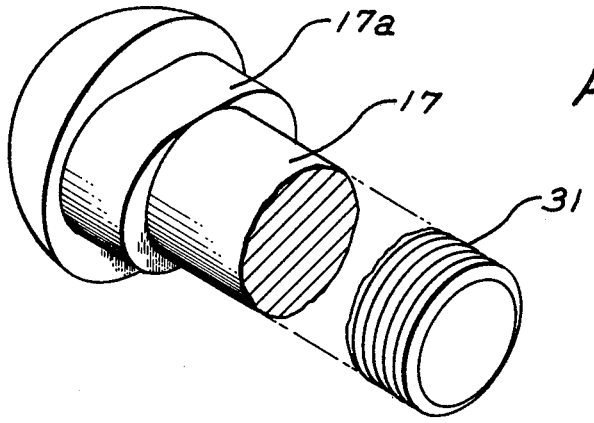
FIG. 6
FIG. 7
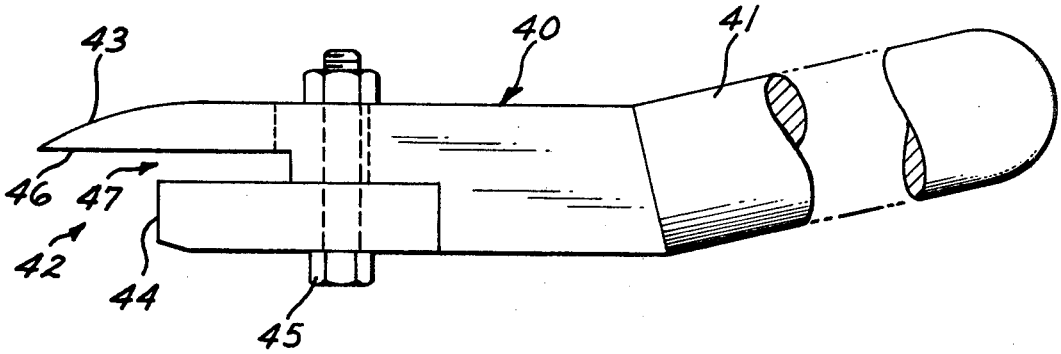
FIG. 8
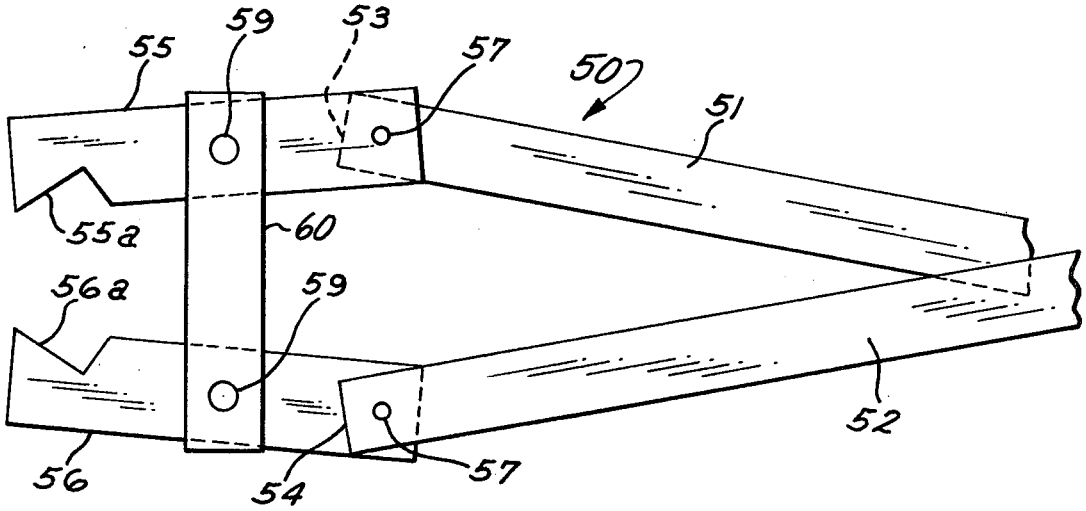

RAIL JOINT BAR BOLT NUT LOCKING ASSEMBLY

BACKGROUND OF INVENTION

This invention relates to improvements in assembling continuing track rail sections with joint bars held together by nut and bolt holding members and, in particular, to a method and apparatus for preventing loosening rotation of the nut after they have been drawn down and tightened on the bolt members.

It is well known in the railroad industry to join continuing sections of track rail with splice bars and joint bars held in place by means of nut and bolt fasteners. Track joints assembled in this manner are economical to construct but suffer from the long standing problem that, as heavy equipment passes over the joints, strong vibrational forces are set up that causes loosening of the nuts to occur.

In a typical joint assembly, abutting ends of rail sections are sandwiched between a pair of elongated splice or joint bars, the bars extending along each rail section for about eighteen inches. Each of the bars has a series of bolt holes spaced about six inches apart which are accurately aligned with corresponding bolt holes in the fish or vertical portion of the rail sections. Conventionally, alternate ones of the bolt holes in the bars are crosswise elongated with flat portions that mate with flat shoulders on the bolt heads to prevent rotation of the bolt after it is inserted through the bar/rail assembly. Thus, the six bolts are usually inserted alternately from opposite sides of the assembly. After insertion of the bolts, with or without elongated backer plates depending on whether electrically insulated bars are used, a lock washer is inserted over the projecting threaded portion of each bolt. A nut is then threaded onto each bolt and drawn down and tightened to a desired torque value established and well known in the railroad industry.

Over long periods of time, repeated passage of heavy rail equipment of the joint sets up high vibrational forces which can cause the nuts to loosen on the bolts despite the action of the heavy duty lockwashers. When this occurs, the splice or joint bars can loosen, vibrate, and become broken setting up a dangerous track condition which can result in train derailment.

It is therefore an object of the present invention to provide improved track rail joint assemblies which obviate the disadvantages and problems of conventional assemblies.

It is a further object of the present invention to provide method and apparatus for restraining loosening rotation of nuts on track rail joint assemblies that is convenient and economical to use.

It is still further an object of the invention to provide method and apparatus that improves the reliability and safety of track joint assemblies.

SUMMARY OF THE INVENTION

Therefore in accordance with the invention, apparatus, and associated method therefore, is provided for track rail joint assemblies having abutting rail sections sandwiched between a pair of joint bars (or splice bars, as the case may be) and held together by nut and bolt fasteners. In accordance with the invention, a nut restraining plate is interposed between the nut and the corresponding joint bar. The plate has at least one and preferably two tabs formed therein on opposite sides of the bolt hole. The tabs are bendable and, after the nut has been drawn down and tightened to the desired torque value, the tab or tabs are bent away from the bar and against the nut to exert a restraining force between the mated, nut and bolt threads to prevent loosening rotation of the nut. Preferably, the tab or tabs are bent up sufficiently close to the side face or faces of the nut to provide an interference fit which physically prevents the nut from rotating. Bending of the tabs may be accomplished by means of a slotted lever or by the jaws at the end of a manually or hydraulically or pneumatically operated scissors mechanism.

BRIEF DESCRIPTION OF THE DRAWINGS

FIG. 6 is a perspective view, partly in broken section, of a conventional bolt used in making track rail joint assemblies.

FIGS. 7–10 illustrate various forms of tools which may be employed, in accordance with the teachings of the invention, in bending up the nut restraining tabs of the plate illustrated in FIGS. 4 and 5.

DETAILED DESCRIPTION

Figure 1:
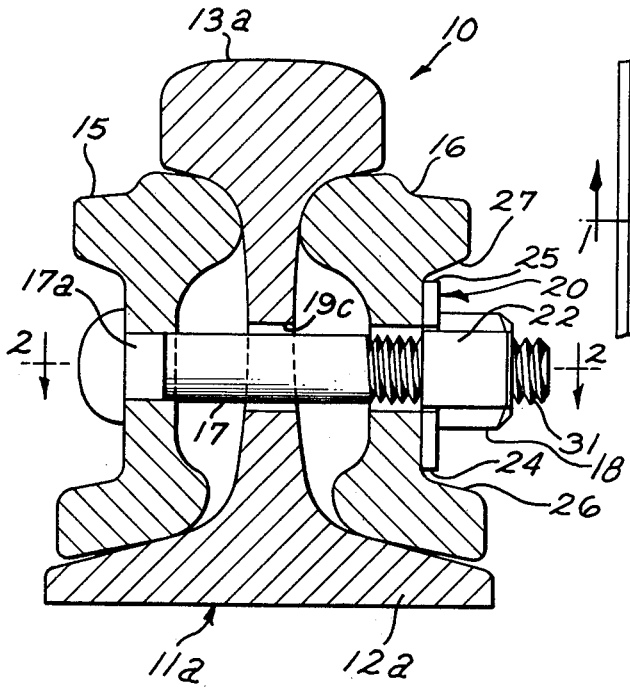
FIG. 1 is a cross section end view taken along section line 1—1 of FIGS. 1 and 2 of a track rail joint assembly constructed in accordance with the teachings of the present invention.
Figure 2:
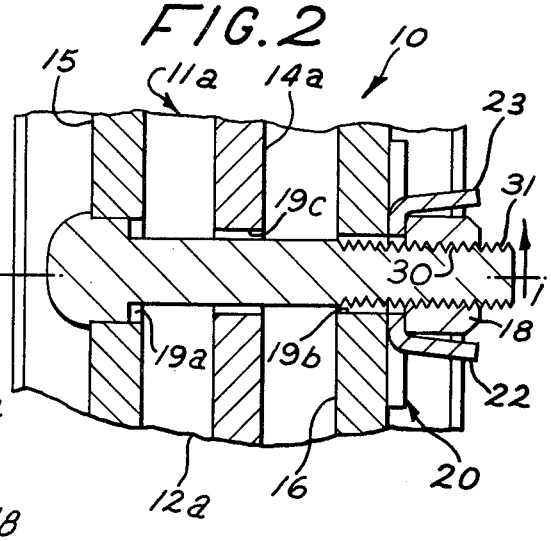
FIG. 2 is a top plan view, in section along the line 2—2, of the assembly of FIG. 1.
Figure 3:
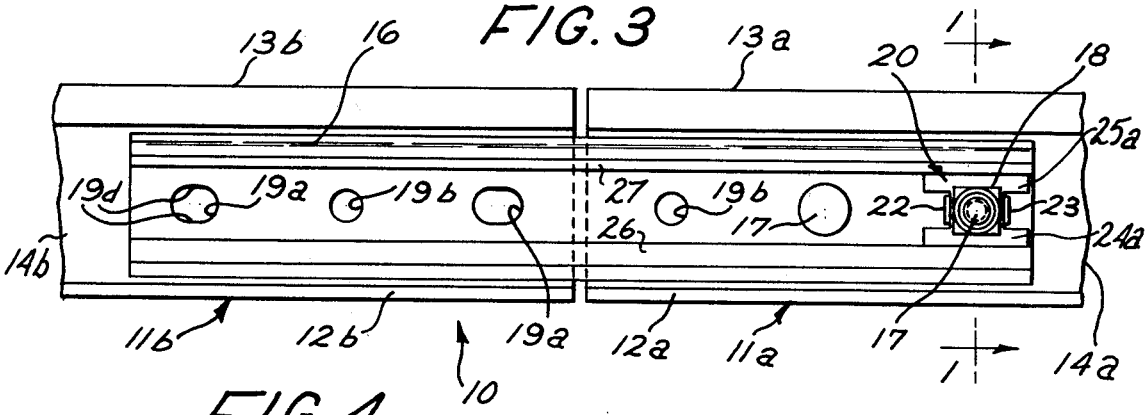
FIG. 3 is a side view of a conventional rail section and joint bar in partially assembled form in accordance with one aspect of the present invention.
Figure 4:
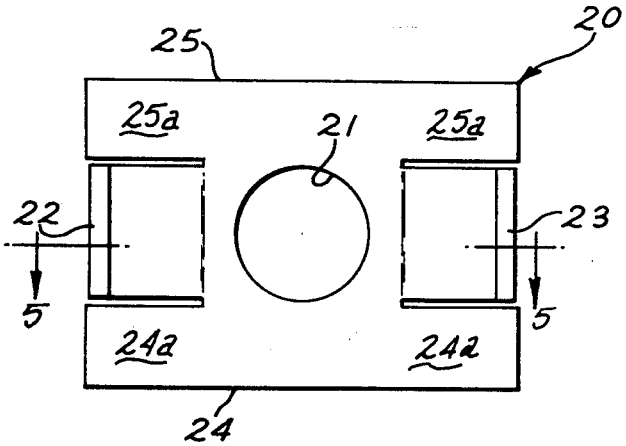
FIGS. 4 and 5 are top and side views, the latter, in section along the line 5—5 of FIG. 4, of a nut restraining plate formed in accordance with the teachings of the present invention.
Figure 5:
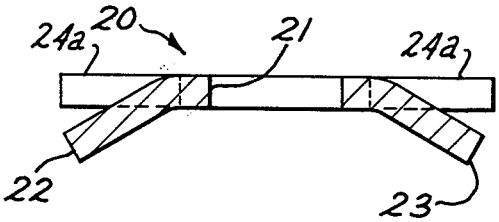

Referring now to FIGS. 1–3, there is shown a track rail joint assembly 10 including a pair of track rails 11*a*, 11*b* each having a base portion 12*a*, 12*b* and a top rail portion 13*a*, 13*b* separated by an integrally formed fish portion 14*a*, 14*b*. Rails 11*a*, 11*b* are shown sandwiched between a pair of joint bars 15, 16 and in end abutting relationship to form a continuous track. While a particular cross sectional shape of joint bars 15 and 16 is shown, it will be appreciated that such bars take a variety of shapes depending on the manufacturer and the particular use for the bar. As used in this specification and claims, the term "joint bar" shall be understood to mean and include "splice bar" as well as any other similar bar employed to align and hold rail sections in end abutting relationship.

The sandwich assembly of joint bars 15, 16 and rails 11*a*, 11*b* are shown held together by bolts 17 and nuts 18. The bars and rail each have bolt holes 19*a*, 19*b* and 19*c* accurately aligned for bolts 17 to pass through to hold rail sections 11*a* and 11*b* in proper longitudinal alignment. Joint bars 15 and 16 may customarily have bolt holes 19*a* and 19*b* alternating between elongated holes 19*a* and round holes 19*b* as shown in FIG. 3. Holes 19*a* have flat portions 19*d* which are intended to mate with corresponding flat shoulders 17*a* at the head end of bolts 17 (FIG. 6) such that when bolt 17 is inserted in place, the bolt is constrained from rotating.

In accordance with an important aspect of the invention, a nut restraining plate 20 having a centrally disposed bolt hole 21 is interposed on bolt 17 between nut 18 and the corresponding joint bar. Referring to FIGS.

4 and 5, there is shown one form of a restraining plate 20 which includes at least one but preferably two bendable tabs 22, 23 disposed on opposite sides of bolt hole 21. As best seen in FIG. 3, tabs 22, 23 are disposed horizontally of the bolt hole and occupy a portion of the vertical side dimension of the plate 20 such that, when the tabs 22, 23 are bent outwardly to engage the nut 18, the plate 20 has an H-shaped configuration with legs 24*a* and 25*a* extending horizontally. The width or crosswise dimension of plate 20, i.e. its vertical dimension after installation, is such that one and preferably both of the lower and upper side edges 24, 25 of horizontally extending legs 24*a*, 25*a* engage elongated stationary projecting surfaces of bar 16. For example, as best seen in FIG. 1, plate 20 is nested in a recessed face portion of bar 16 with edges 24 and 25 engaging lower and upper outwardly projecting flanges 26 and 27, respectively, of bar 16. In some cases where bar flanges are not provided, plate 20 is made wide enough (vertical height as seen in FIG. 1) such that at least the bottom edge 24 engages the base portion 12*a* of rail 11*a*. Preferably, in this instance, the top edge 25 would engage the underside of rail top portion 13*a*. The purpose of this arrangement, as will become apparent, is to restrain the plate 20 from rotating after it is positioned on bolt 17 against bar 16 and it can be appreciated from FIG. 3 that it is the engagement of the lower and upper sides 24, 25 of the extended legs 24*a*, 25*a* with stationary projecting flange surfaces of the rail joint assembly, either of the bar or the rail, which provides the leveraged strength to withstand the heavy stress forces of rolling stock passing over the rail joint assembly.

Once nut 18 is tightened down on the bolt 17 against plate 20, tabs 22 and 23 are bent outwardly, away from bar 16 to provide a high degree of force against nut 18, which in turn causes a high degree of force to be exerted by the threads 30 of nut 18 against the threads 31 of nut 17. While applicant is unable to state precisely the value of such force, it is believed to be significantly greater, such as three to four times greater, than the comparable inter thread force exerted by conventional heavy duty lock washers used in prior art rail joint assemblies. Additionally, it will be noted that tabs 22 and 23, when bent outwardly, provide an interference fit preferably with the flat faces on opposite sides of nut 18 thus further restraining nut 18 from loosening rotation (by virtue of the fact that plate 20 is itself prevented from rotating as previously described).

Plate 20 is preferably made of a malleable steel material to permit bending of tabs 22, 23 without breaking and may, for example, be stamped out of low cost 10–10 or 10–20 low carbon hot rolled steel with a thickness of about ¼". In its preferred form, plate 20 is formed either in its initial stamping or by subsequent bending with tabs 22, 23 slightly bent out of the plane of the remainder of plate 20 prior to its being placed on bolt 17. This initial bending of tabs 22, 23 is not enough to cause the tabs to interfere with the wrenching down and tightening of nut 18 on bolt 17 but is preferentially sufficient to allow suitable bending tools to be inserted under the tabs for the necessary bending operation.

Referring now to FIG. 7, there is shown one form of bending tool 40 which may be employed to bend tabs 22, 23 as described above. Thus tool 40 includes a lever arm 41 for example 36" to 48" in length, and angled slightly from jaw end 42. Jaw end 42 is comprised of a curved, tapered claw 43 having a pointed tip end adapted to fit between the joint bar and the tabs of plate 20. A holding foot 44 is fixed on jaw end 42 by means of a nut and bolt fastener 45 and is spaced from the tab engaging surface 46 to form a tab receiving slot 47. In operation, after nut 18 is tightened to a desired torque level on bolt 17, claw 43 is inserted under one of the tabs and rocked on the curved surface of claw 43 against the surface of the joint bar to force the tab away from the bar. When sufficient clearance is achieved, the tool 40 is removed turned around and slot 47 reinserted over the tab with claw 43 between the tab and the nut whereupon the tab is bent to its final position adjacent the side face of nut 18 by lever action of the tool 40. Thus tool 40 provides a convenient manual means of bending tabs 22 and 23 to their final "locking" position.

In FIG. 8, an alternate form of tool 50 operating on the scissors concept is shown. Thus elongated arms 51 and 52 are pivoted at an intermediate pivot point (not shown) such that arm ends 53 and 54 move apart during the bending operation. Ends 53, 54 are movably fastened to jaw links 55 and 56 respectively by means of pins 57 at one end of each link. The other end of each link is formed with a tab engaging jaw surface 55*a* and 56*a* while the intermediate points are pivotally fastened via fulcrum pins 59 to opposite ends of spacer bar 60. In operation, jaw surfaces 55*a*, 56*a* are positioned so as to be slightly under tabs 22, 23 and arms 51, 52 are operated to move ends 53 and 54 apart. This causes jaw links 55, 56 to pivot about fulcrum pins 59 forcing jaws 55*a*, 56*a* together resulting in a bending of tabs 22, 23 away from joint bar 16 up and against nut 18 (FIG. 2). The lengths of arms 51, 52 and the location of the arm pivot (not shown) are determined by well known design techniques to provide the requisite force to bend the tabs 22, 23.

Figure 9:
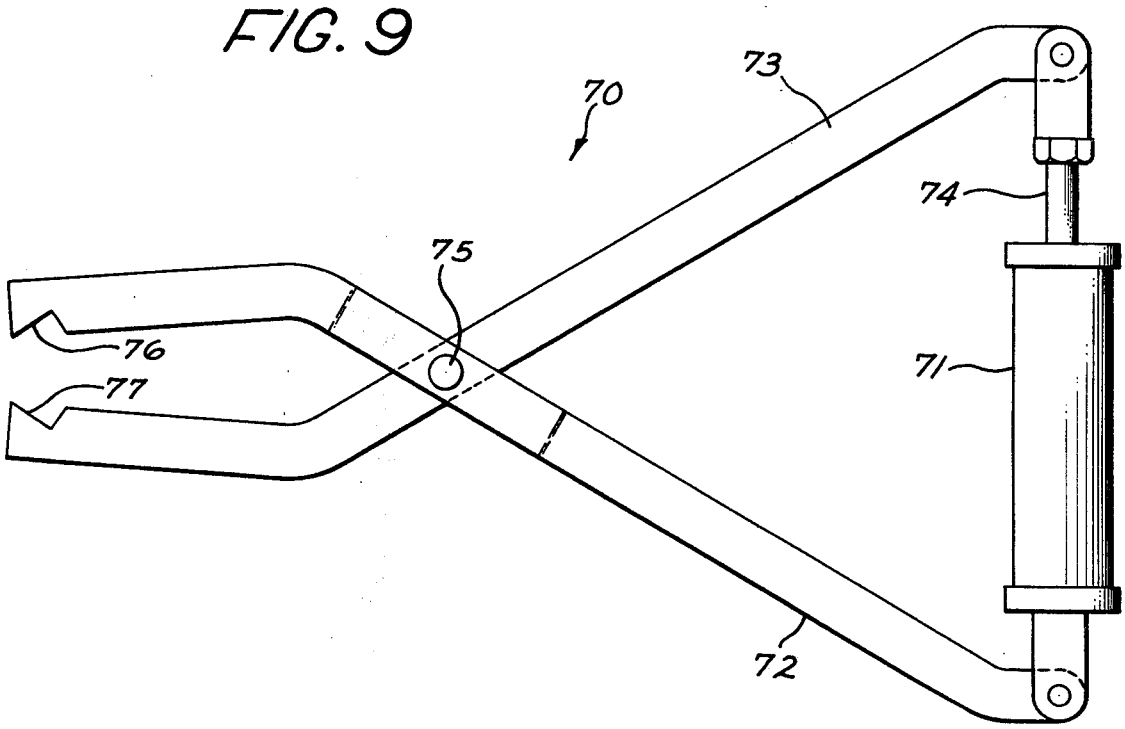
Figure 10:
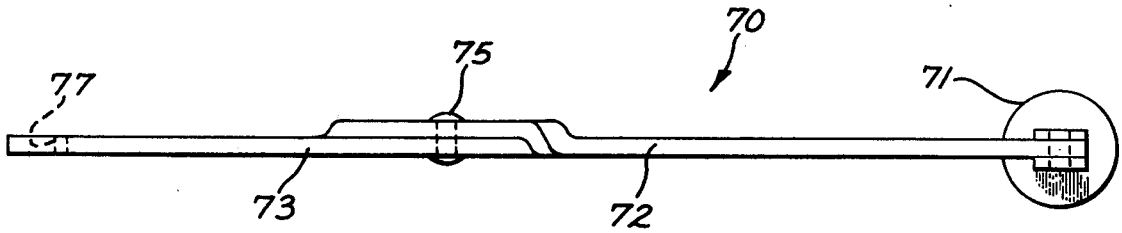

In FIGS. 9 and 10, a further alternate form of tool 70 is shown which is useful in practicing the present invention. With this tool, a pneumatic or hydraulic actuating cylinder is fixed at one end to scissors arm 72 and the actuating piston rod 74 is fixed at the other end to scissors arm 73. Arms 72 and 73 are pivoted at pin 75 such that outward or inward movement of rod 74 by means of suitable hydraulic or pneumatic power source (not shown) causes jaw ends 76 and 77 to close and open respectively. As with tool 50 of FIG. 8, jaws 76 and 77 are inserted slightly under tabs 22, 23 with the power cylinder 71 providing the requisite force to bend the tabs.

Once tabs 22, 23 are bent in place, it becomes virtually impossible for the nuts to loosen as heavy rail cars and engines pass over the rail joint. By maintaining the nuts firmly tightened down on the bolts, loosening and vibration of the joint bars 15, 16 with consequent breakage are greatly if not entirely eliminated.

While, in accordance with the patent statutes, there has been described what at present is believed to be one or more preferred embodiments of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. Apparatus for maintaining track rail joints to proper alignment comprising:

a pair of elongated joint bars adapted to span predetermined lengths of adjoining rail sections and to fit between the rail head and rail base and having a plurality of bolt holes aligned with corresponding bolt holes of the fish of each length of rail sections;

a plurality of bolts individually extending through said aligned bolt holes;

a nut threaded onto each of said bolts;

and a plate interposed between each of said nuts and one of said joint bars, each plate having a bolt hole and a pair of horizontally extending tabs disposed on opposite sides of the bolt hole and sized approximately that of the hole diameter to be bent away from the joint bar and against the nut after the nut has been drawn down and tightened onto the plate to exert restraining force on the nut and prevent loosening rotation of the nut, the plate having an H-shaped configuration after bending of the tabs with the legs of the H extending horizontally, the width of the plate being sufficient for lower and upper sides of the plate legs to engage elongated stationary projecting lower and upper surfaces of the assembled rail sections and bars so as to prevent rotation of the plate after the nut has been tightened.

2. The apparatus of claim 1 in which the plate is comprised of a relatively strong and pliant metallic material permitting the bending of said tabs without breaking.

3. Apparatus for restraining a nut from loosening rotation on a bolt of a track rail section and joint bar assembly comprising:

a plate member having a bolt hole and being adapted to be interposed between the nut and joint bar of said assembly, the plate having a pair of tabs formed therein adjacent the bolt hole and sized approximately that of the hole diameter on opposite sides thereof horizontally and adapted to be bent away from the plate after the nut has been tightened on the bolt to exert restraining force on the nut, the tabs being so formed in the plate so that, upon bending of the tabs after installation, the plate has an H-shaped configuration with horizontally extending legs having lower and upper edges, the width of plate being sufficient for said lower and upper edges of the plate member legs to engage upper and lower elongated stationary projecting surfaces of the joint bar and rail section assembly to prevent rotation of the plate after the assembly has been formed and the tabs have been bent.

4. The apparatus of claim 3 in which said pair tabs are adapted to be bent along lines generally spaced apart by an amount approximately equal to the lateral dimension between side faces of the nut.

5. The apparatus of claim 3 in which said tabs are formed to be slightly raised from the plane of the remainder of the plate member to facilitate insertion of a bending tool after the nut has been tightened on the bolt.

6. Method of assembling abutting track rail sections and mating joint bars with nut holding members, the method comprising:

interposing a nut restraining plate between each bolt and a corresponding joint bar, the plate having a bolt hole and a pair of bendable tabs sized approximately that of the hole diameter adjacent but spaced from the bolt hole on opposite sides thereof horizontally and having horizontally extending legs such that, after bending of the tabs, the plate has an H-shaped configuration;

positioning the plate with lower and upper sides of said horizontally extending legs engaging lower and upper elongated stationary projecting surfaces of the resulting rail section and joint bar assembly;

tightening the nut on the bolt;

and bending the tabs toward the nut and away from the joint bar to exert a restraining force on the nut to prevent loosening rotation of the nut.

* * * * *